United States Patent [19]

Johansson

[11] 3,957,240

[45] May 18, 1976

[54] SCAFFOLDING BRACKET

[75] Inventor: Kurt Johansson, Torslanda, Sweden

[73] Assignee: AB Gotaverken, Goteborg, Sweden

[22] Filed: Apr. 10, 1975

[21] Appl. No.: 566,688

[52] U.S. Cl. ..... 248/214; 248/226 R; 248/235; 182/82; 182/222

[51] Int. Cl.[2] ..... E04G 3/14; E04G 5/06

[58] Field of Search ..... 182/82, 222, 223; 248/235, 226 C, 226 A, 214, 226 R

[56] References Cited

UNITED STATES PATENTS

| | | | |
|---|---|---|---|
| 2,080,261 | 5/1937 | Funk | 248/226 |
| 2,104,982 | 1/1938 | Forester | 182/58 |
| 2,665,869 | 1/1954 | Samuels | 248/214 |
| 3,143,328 | 8/1964 | Damiano | 248/228 |

FOREIGN PATENTS OR APPLICATIONS

| | | | |
|---|---|---|---|
| 1,019,026 | 2/1966 | United Kingdom | 248/235 |

*Primary Examiner*—Reinaldo P. Machado
*Attorney, Agent, or Firm*—Holman & Stern

[57] ABSTRACT

A scaffolding bracket for attachment to a ship's bulkhead, or other vertical wall structure, having flanged, horizontally extending strengthening bars is provided with a beam and a hook member for engagement with a strengthening bar, at an arbitrarily selected point. One end of the beam, in mounted position, reaches in below the bar and is provided with an upwardly directed stanchion, upon which a two armed lever is pivotably mounted. A longer part of this lever is directed towards the hook member, leaving a clearance between its end and the hook member suitable for the reception of the flange of the strengthening bar.

3 Claims, 2 Drawing Figures

SCAFFOLDING BRACKET

BACKGROUND OF THE INVENTION

Within the shipbuilding industry there is a marked tendency towards prefabrication of large sections. This raises an increased need for scaffolding, primarily where the sections are built, and furthermore when the sections are built into the ship's hull.

Repair works at the ship's hull will also, later on, make the erection of scaffolding necessary.

Certain portions of the ship's hull have proven difficult with respect to the erection of scaffolding, i.e. the side plating and other vertical bulkhead faces, which are provided with horizontally extending strengthening bars provided with a downwardly turned flange along its edge remote from the vertical surface. These bars will, for obvious reasons, provide a bad support for a scaffolding, it being a definite desideratum that clips and other fastening members should not be welded to the strengthening bars, or to the wall surface. Such clips would mean extra work and would be a hindrance during normal clearing of the cargo spaces.

SUMMARY OF THE INVENTION

A bracket according to the invention includes a beam adapted to protrude horizontally from a strengthening bar and to be attached thereto by means of a hook member adapted to rest upon the upper face of the strengthening bar.

The invention is characterized in that a portion of the beam, in mounted position reaching in below the strengthening bar, is provided with a support including a fixed, upwardly directed stanchion, located about at the end of the beam, as well as an arm being parallel to the beam and pivotably connected to the stanchion in such a manner that a substantial portion thereof will be directed towards the hook member, while a shorter portion extends away from the latter.

DESCRIPTION OF A PREFERRED EMBODIMENT

Figure 1:
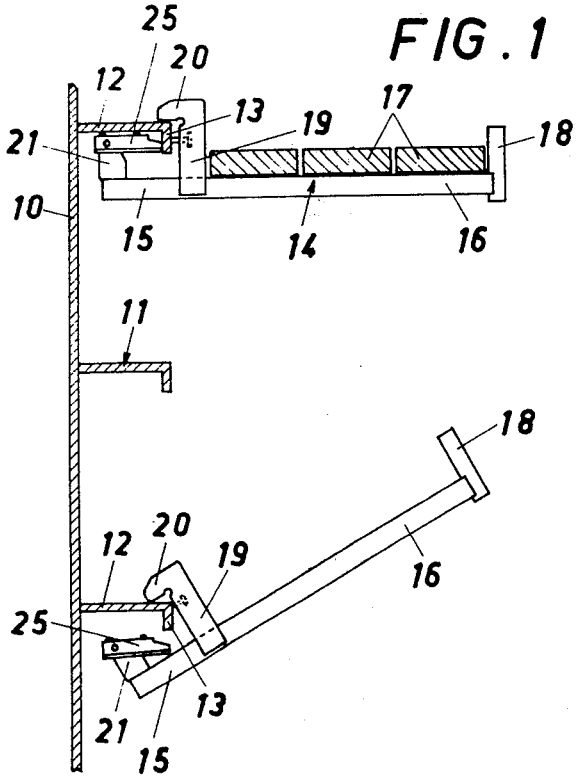
FIG. 1 schematically shows a portion of the side plating of a ship with brackets being mounted, and FIG. 2, on a larger scale, shows a bracket in mounted position.

FIG. 1 shows a portion 10 of the side plating of a ship having horizontally extending strengthening bars 11. Each bar includes a main portion 12 and a downwardly directed outer flange 13.

It is desirable to attach to such a vertical wall structure, a scaffolding resting on brackets. Each bracket includes a beam 14 having a first portion 15 which, in a mounted position, will reach or extend in below the bar and a second portion 16 extending sufficiently far outside the bar to provide a support for a platform of required breadth. The platform is, in the upper part of FIG. 1, indicated by three planks or boards 17, and the beam 14 is, at its outer end, provided with a fitting 18 to which a stanchion (not shown) forming part of a railing will be mounted.

The bracket is mounted at the strengthening bar 11 by means of a hook member 19, having a height mating with the depth the flange 13 and a head 20 directed towards the wall and adapted to rest upon the top face of the main portion 12 of the strengthening bar to carry the bracket and the load supported thereby.

In order to prevent the bracket from sliding off the strengthening bar, the first portion 15 of the beam is provided with an upwardly extending stanchion 21, located about at the inner end of the beam. An arm 22 is mounted at the stanchion by means of a pivot 23. This is located in such a manner that the arm has a short portion 24 extending outside of the pivot axis. The longer and heavier portion 25 of the arm is directed towards the hook member 19 and extends parallel to the beam. A length of the longer portion 25 is selected so as to permit the reception of the flange 13 between the end of the arm and the upright portion of the hook member.

If the strengthening bars are uniform with respect to the thickness of the material, the measure between the end of the arm and the hook member can be selected rather close to the thickness of the flange. Usually it will, however, be necessary to take different thicknesses into consideration, and it will be necessary to calculate with a certain clearance.

In order to secure the attachment of the bracket to the structure, also during such turning operations, which often are required when producing a subsection, and during the transportation thereof to, and fitting into the ship's hull, the hook member 19 is provided with a locking screw 26.

The fitting of a bracket occurs in the manner shown in the lower portion of FIG. 1. The bracket is brought towards the wall structure in an oblique position with its outer end lifted. The longer portion 25 of the arm 22 will fall downwards against the beam due to its weight and will leave an ample space between its top face and hook member 19 for the introduction of the flange 13 of the strengthening bar. In order to facilitate this movement, the inward end of the arm 22 is obliquely cut, as shown at 27, so the top face of the arm will be shorter than its lower face. There will, however, still remain a satisfactory contact face for engagement with the flange.

When the beam is brought to a horizontal position, the short portion 24 of arm 22 will swing the arm to a position parallel to the main portion 12 of the strengthening bar. In order to facilitate this movement, each portion 24 and 25 of the arm is provided with a projection 29 and 30, respectively, with the one at the longer portion being located about midway between the pivot axis and the free end of the arm.

Figure 2:
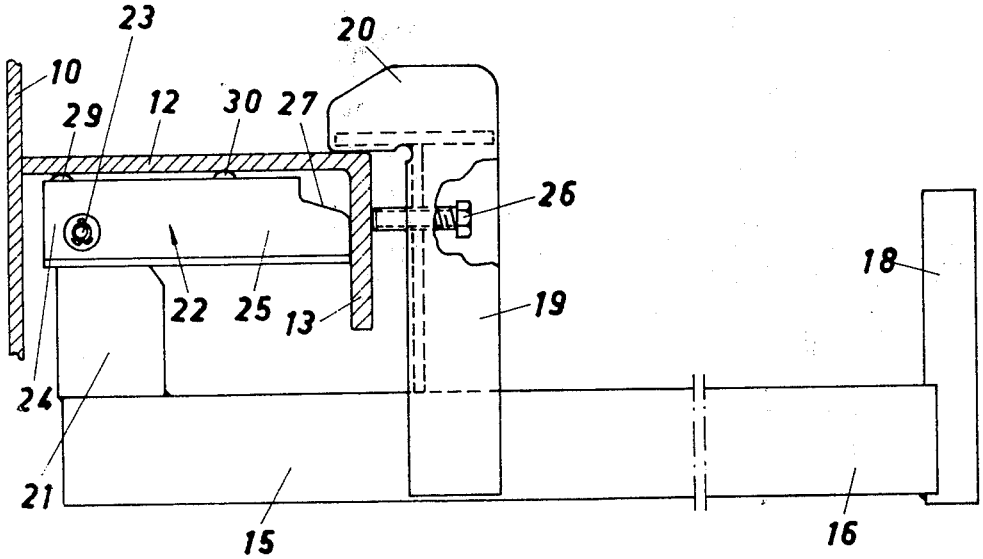

As is evident from FIG. 2, the arm 22 will be forced against the main portion 12 of the strengthening bar, so even if the locking screw 26 is not tightened, there is no risk of the bracket slipping of the bar, as the clearance between the end of the arm and the hook member is less than the extension of the head 20.

Besides ships, the bracket will, of course, also be applicable to other vertical steel structures having horizontal strengthening bars of the type described herein, for instance stationary petroleum storage tanks.

What I claim is:

1. A scaffolding bracket for use at a vertical wall provided with horizontally extending strengthening bars, each bar having a downwardly turned flange along its edge remote from the wall, so as to provide a horizontal carrying surface and a retaining surface parallel to but spaced from the wall, said bracket including a beam having first and second portions, said beam being adapted to be attached to one of said strengthening bars by means of a hook member adapted to rest upon the supporting surface of said strengthening bar so the first portion thereof, in mounted position, will reach in below the one strengthening bar, while the second portion thereof protrudes horizontally outwards from the one strengthening bar, the improvement of a fixed, upwardly directed stanchion adjacent the inward end of the first portion of the beam, an arm, and means for pivotably connecting the arm to the upper end of said stanchion so a substantial part of said arm will be directed towards the hook member, while a shorter part of the arm is directed away from the retaining surface of said one bar.

2. The bracket according to claim 1, in which the end of the substantial part of arm, turned towards the hook member, is provided with an oblique surface, so its top face will be shorter than its lower face.

3. The bracket according to claim 1, in which the arm, upon its top face, is provided with two projections, with one projection being located about midway of each of the substantial and shorter parts, respectively, of the arm.

* * * * *